US007842161B2

(12) United States Patent
van Heiningen et al.

(10) Patent No.: US 7,842,161 B2
(45) Date of Patent: Nov. 30, 2010

(54) PRE-EXTRACTION AND SOLVENT PULPING OF LIGNOCELLULOSIC MATERIAL

(75) Inventors: Adriaan Reinhard Pieter van Heiningen, Orono, ME (US); Sung-Hoon Yoon, Auburn, AL (US); Haixuan Zou, Orono, ME (US); Jianer Jiang, Mason, OH (US); Gopal C. Goyal, Mason, OH (US)

(73) Assignees: The University of Maine System Board of Trustees, Bangor, ME (US); International Paper, Memphis, TN (US)

( * ) Notice: Subject to any disclaimer, the term of this patent is extended or adjusted under 35 U.S.C. 154(b) by 0 days.

(21) Appl. No.: 12/005,432

(22) Filed: Dec. 26, 2007

(65) Prior Publication Data

US 2008/0196847 A1 Aug. 21, 2008

Related U.S. Application Data

(63) Continuation-in-part of application No. 11/640,820, filed on Dec. 18, 2006.

(51) Int. Cl.
*D21C 3/22* (2006.01)
*D21C 3/02* (2006.01)
*D21C 3/20* (2006.01)

(52) U.S. Cl. ..... 162/43; 162/9; 162/17; 162/41; 162/72

(58) Field of Classification Search ..... 162/9, 162/17, 41, 72; 435/72
See application file for complete search history.

(56) References Cited

U.S. PATENT DOCUMENTS 2,904,460 A * 9/1959 Nolan ..... 162/25
3,354,029 A * 11/1967 Aurell et al. ..... 162/41
4,436,586 A 3/1984 Elmore
4,561,936 A 12/1985 Samuelson
5,032,224 A 7/1991 Ahluwalia
5,217,574 A 6/1993 Griggs
5,424,417 A 6/1995 Torget et al.

(Continued)

FOREIGN PATENT DOCUMENTS

WO WO 2006/134126 A1 * 12/2006

OTHER PUBLICATIONS

Van Heiningen, Hemicellulose Extraction and Its Integration in Pulp Production (Part of the Quarterly Forest Products Industry of The Future Quarterly status report for Q1 05) [downloaded from www.p2pays.org], quarterly report available Jun. 22, 2005 [downloaded online Oct. 6, 2008], Department of Energy: EERE, p. 53-63.*

(Continued)

*Primary Examiner*—Eric Hug
*Assistant Examiner*—Anthony J Calandra
(74) *Attorney, Agent, or Firm*—MacMillan, Sobanski & Todd, LLC

(57) ABSTRACT

A process of treating a lignocellulosic material includes a pre-extraction step in which hemicellulose is extracted from the lignocellulosic material. Then, in a solvent pulping step, the lignocellulosic material is separated into pulp by contacting the lignocellulosic material with a cooking liquor comprising a solvent. In one embodiment, the solvent has a boiling point of at least about 150° C. In another embodiment, the cooking liquor comprises a mixture of solvent and water.

22 Claims, 1 Drawing Sheet

Pulping Process Including Pre-Extraction and Solvent Pulping Steps

U.S. PATENT DOCUMENTS

| | | | | |
|---|---|---|---|---|
| 5,503,996 | A | 4/1996 | Torget et al. | |
| 5,589,033 | A | 12/1996 | Tikka et al. | |
| 5,705,369 | A | 1/1998 | Torget et al. | |
| 6,413,367 | B1 | 7/2002 | Svedman et al. | |
| 6,419,788 | B1 | 7/2002 | Wingerson | |
| 2004/0200587 | A1 | 10/2004 | Herring et al. | |
| 2004/0200589 | A1 | 10/2004 | Herring et al. | |
| 2004/0244925 | A1 | 12/2004 | Tarasenko | |
| 2006/0225852 | A1* | 10/2006 | Pekarovic et al. | 162/29 |
| 2007/0284068 | A1* | 12/2007 | Francis et al. | 162/17 |
| 2008/0032344 | A1* | 2/2008 | Fallavollita | 435/72 |
| 2008/0295986 | A1* | 12/2008 | Pekkala | 162/175 |

OTHER PUBLICATIONS

Gullichsen et al., Chemical Pulping 6B,1999, Fapet Oy,p. B410-B414.*

April, Bharoocha et al., Prehydrolysis achieves higher organosolv delignification, 1982, TAPPI, 65(2), 41-44.*

Violette et al., Selectivity Improvement during oxygen delignification by adsoption of polymeric additives, 2002, TAPPI Int'l. Bleaching Conference, whole document.*

Werpy et al., Top Value Added Chemicals from Biomass, Aug. 2004, U.S. Department of Energy, vol. 1, p. 1, 2, 49-51.*

Ban et al., Insight into the Chemical Behavior of Softwood Carbohydrates during High-Sulfidity Green Liquor Pretreatment, 2004, Ind. Eng. Chem. Res, 43, 1366-1372.*

Singh et al., Green Liquor Chip Pretreatment as a Feasible Method for the Enhancement of Softwood Pulp Chemical Properties, Oct. 2000, IPST Technical Paper Series, No. 886, whole document.*

* cited by examiner

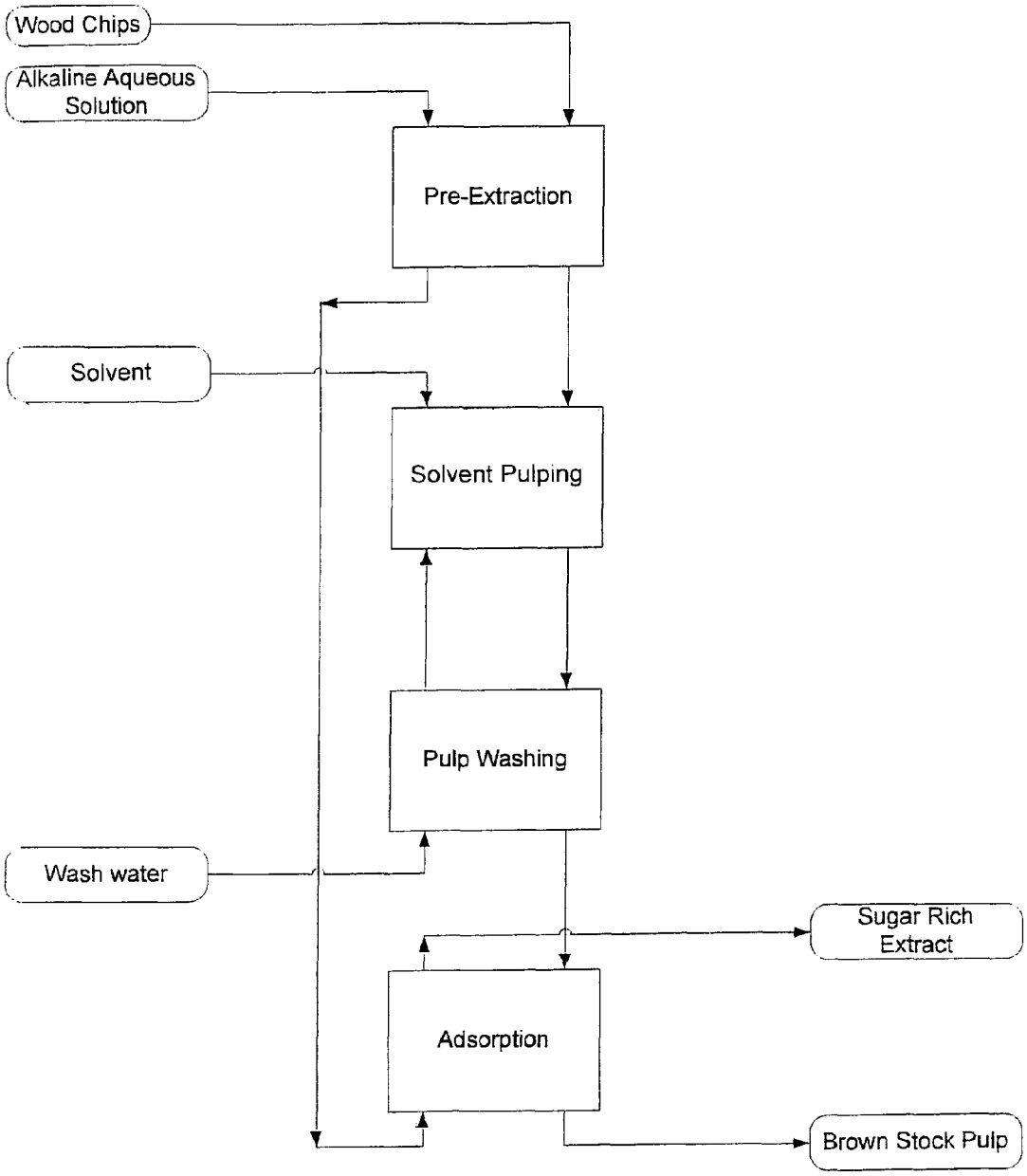
Fig. 1 Pulping Process Including Pre-Extraction and Solvent Pulping Steps

PRE-EXTRACTION AND SOLVENT PULPING OF LIGNOCELLULOSIC MATERIAL

CROSS-REFERENCE TO RELATED APPLICATION

This application is a continuation-in-part of copending U.S. application Ser. No. 11/640,820, filed Dec. 18, 2006, the disclosure of which is incorporated herein by reference.

BACKGROUND OF THE INVENTION

This invention relates in general to processes of treating lignocellulosic materials and in particular to a process of producing a lignocellulosic pulp such as a wood pulp.

Lignocellulosic materials, such as wood, are plant materials made up primarily of cellulose, hemicellulose and lignin. The cellulose is the chief structural element and major constituent of the plants. It consists of a fibrous cellulose portion made from polymeric chains that are aligned with one another and form strong associated bonds with adjacent chains. The lignin is a three-dimensional polymeric material that bonds the cellulosic fibers and is also distributed within the fibers themselves. Lignin is largely responsible for the strength and rigidity of the plants. The hemicellulose is a polysaccharide that is a component of the cell walls of the plants.

The wood is converted to pulp for use in paper manufacturing. Pulp comprises wood fibers capable of being slurried or suspended and then deposited on a screen to form a sheet of paper. There are two main types of pulping techniques: mechanical pulping and chemical pulping. In mechanical pulping, the wood is physically separated into individual fibers. In chemical pulping, the wood chips are digested with chemical solutions to solubilize portions of the lignin and hemicellulose and thus permit their removal in the waste pulping liquor.

The commonly used chemical pulping processes include the kraft process, the sulfite process, and the soda process. The kraft process is the most commonly used and involves digesting the wood chips in an aqueous solution of sodium hydroxide and sodium sulfide. Environmental and economic limitations associated with the kraft process, however, have stimulated a search for alternative pulping processes.

Solvent pulping is an alternative to the kraft process in which delignification of wood chips is accomplished by fragmentation of the lignin by the dissolving action of solvent used in the cooking liquor. Low boiling temperature solvents are normally used in a solvent pulping process.

SUMMARY OF THE INVENTION

This invention relates to a process of treating a lignocellulosic material. In a pre-extraction step, hemicellulose is extracted from the lignocellulosic material. Then, in a solvent pulping step, the lignocellulosic material is separated into pulp by contacting the lignocellulosic material with a cooking liquor comprising a solvent. In one embodiment, the solvent has a boiling point of at least about 150° C. In another embodiment, the cooking liquor comprises a mixture of solvent and water.

Various aspects of this invention will become apparent to those skilled in the art from the following detailed description of the preferred embodiments, when read in light of the accompanying drawing.

BRIEF DESCRIPTION OF THE DRAWING

FIG. 1 is a block diagram of a process of treating a wood chips to produce pulp, the process including pre-extraction and solvent pulping steps according to the invention.

DETAILED DESCRIPTION OF THE PREFERRED EMBODIMENT

The lignocellulosic material which is treated in the process can be any plant material made up primarily of cellulose, hemicellulose and lignin. In some embodiments the lignocellulosic material is wood, such as hardwood or softwood. The lignocellulosic material can be in any suitable form at the start of the process. In some embodiments the lignocellulosic material is in a comminuted form, for example in the form of wood chips. FIG. 1 is a block diagram of a process according to one embodiment of the invention. It is seen that the process starts with wood chips.

As shown in FIG. 1, the wood chips are subjected to a pre-extraction step of the process. Conventional wood pulping processes do not include such a pre-extraction step. In the pre-extraction step, hemicellulose and other components are extracted from the wood chips. In some embodiments, the pre-extraction step extracts at least about 4%, more particularly at least about 8%, of the lignocellulosic material as measured on a dry material weight basis.

The hemicellulose extraction can be accomplished in any suitable manner. In one embodiment, the hemicellulose is extracted by contacting the lignocellulosic material with an aqueous solution that includes a basic material such as an alkali material. Any suitable basic material can be used in the pre-extraction step. Some nonlimiting examples include alkali metal hydroxides, alkali metal borates, alkali metal carbonates, and mixtures thereof.

The pre-extraction step can be conducted using any suitable process equipment and conditions. In one embodiment, the lignocellulosic material is soaked in the aqueous solution such that it becomes impregnated with the solution, and the temperature of the solution is raised and held at an elevated temperature for a suitable time to reach the desired pH. In some embodiments the conditions of the pre-extraction step include a temperature of extraction as for example within a range of from about 110° C. to about 200° C., e.g. from 130° C. to about 180° C., or from about 135° C. to about 170° C., and a time of extraction within a range of from about 30 minutes to about 150 minutes, e.g., from about 45 minutes to about 120 minutes.

Contacting the lignocellulosic material with the aqueous solution during the pre-extraction step may cause acidic material(s) to be released from the lignocellulosic material into the solution. For example, such acidic materials may include wood sugars and to a lesser extent lignin. The wood sugars include the extracted hemicellulose and other sugars. In one embodiment, the aqueous solution at the beginning of the pre-extraction step is sufficiently basic to at least partly neutralize the acidic material(s) released during the extraction, so that the aqueous solution at the end of the pre-extraction step has a pH within a range of from about 4.5 to about 11.0, e.g. from about 5 to about 10 or from about 5 to about 9.5, when measured at a temperature of 20° C. In a particular embodiment, the aqueous solution at the end of the pre-extraction step is a near-neutral solution having a pH within a range of from about 6 to about 8.

In another embodiment, the pre-extraction step is conducted by soaking the lignocellulosic material in water or a water/solvent mixture, without using a sodium containing material or a sulfur containing additive. However, a potassium containing material may be included in the water in one embodiment. A presteaming step may be included before the soaking.

The process may further include a solution removal step, following the pre-extraction step, in which at least part of the aqueous solution including extracted hemicellulose is removed from the lignocellulosic material. In one embodiment at least about 60 wt %, e.g., at least about 75 wt %, of the aqueous solution is removed from the lignocellulosic material. The solution can be removed/withdrawn in any suitable manner.

In one embodiment, at least part of the aqueous solution removed from the lignocellulosic material is recycled by adding it to the aqueous solution at the beginning of the pre-extraction step. The process shown in FIG. 1 includes recycling of part of the removed aqueous solution. The recycling reduces the water concentration and increases the dissolved solids (e.g., sugar) concentration in the aqueous solution.

The process of treating a lignocellulosic material also includes a solvent pulping step. In the solvent pulping step, the lignocellulosic material is separated into pulp by contacting the material with a cooking liquor comprising a solvent. Solvent penetration and diffusion of lignin out of the material may be significantly facilitated by the hemicellulose pre-extraction, thus resulting in faster delignification during the pulping step.

Any solvent can be used in the pulping step that is suitable for separating the lignocellulosic material into pulp by dissolving the lignin. In some embodiments, the solvent may have a boiling point around or above the softening temperature of lignin in wood. For example, the solvent may have a boiling point of at least about 150° C., particularly at least about 160° C., and more particularly at least about 170° C.

Other properties of the solvent that may be considered in selecting the solvent include solubility of the solvent in water, solubility of lignin in the solvent, and low toxicity of the solvent. When the cooking liquor is a mixture of solvent and water, a solvent that is completely miscible in water provides uniform contact of the solvent with the lignocellulosic material during the pulping step.

In one embodiment, the solvent is selected so that lignin is highly soluble in the solvent. A high solubility of lignin in the solvent is desirable for favorable delignification properties during the pulping step. The lignin solubility can be determined by any suitable method. For example, it may be estimated using Hansen's three component solubility parameter or the Hildebrand total solubility parameter.

In one aspect, the process of treating a lignocellulosic material allows the production of high value-added products besides pulp. For example, in one embodiment, at least part of the hemicellulose extracted from the lignocellulosic material in the pre-extraction step is converted into the solvent. For example, the solvent may be produced at a yield of at least about 30%, more particularly at least about 40%, from the extracted hemicellulose. In another embodiment, the sugars in the waste stream at the end of the overall process are separated and converted into the solvent. The solvent for use in the solvent pulping step may be one that can be produced from the separated hemicellulose and/or other sugars by chemical and/or biological conversion or other means.

In another embodiment, at least part of the solvent at the end of the solvent pulping step is recovered and recycled into the solvent pulping process. For example, a closed cycle solvent recovery process may be developed for the recovery and recycling of the solvent. The solvent for use in the solvent pulping step may be one that can be relatively easily obtained in purified form from the pulping liquor. For example, it may be advantageous if the solvent can be separated by crystallization at low temperature or by a simple conversion to an insoluble compound.

The solvent used in the pulping step can be either organic or inorganic. In one embodiment, the solvent is an organic solvent, and in a more particular embodiment it is an oxygen-containing organic solvent. Some nonlimiting examples of solvents that may be used include 1,3-propanediol, 1,4-butanediol, tetrahydro-furfuryl alcohol, succinic acid, levulinic acid, lactones derived from hydroxy propionic or hydroxyl butyric acid, or mixtures thereof.

In some embodiments, in addition to the solvent, the cooking liquor for the solvent pulping step further comprises water or other aqueous cooking medium mixed with the solvent. The solvent and the water can be used in any suitable amounts. In one embodiment, the cooking liquor has a ratio of solvent to water within a range of from about 1:1 to about 5:1, and more particularly within a range of from about 2:1 to about 4:1.

Besides the water and solvent, the cooking liquor for the solvent pulping step can contain other materials that benefit the process. In one embodiment, the addition of sulfur and sodium is avoided because of catalyst poisoning concerns. Potassium as an additive may be considered because this is naturally present in wood and will dissolve in the cooking liquor.

Any suitable process conditions can be used in the solvent pulping step. In one embodiment, the use of a high boiling solvent allows the pulping step to be conducted at a relatively low pressure which may result in safer operating conditions and/or lower capital costs.

The solvent pulping step can be conducted at any suitable temperatures. In one embodiment, the cooking liquor during the pulping step has a temperature within a range of from about 180° C. to about 250° C., and more particularly from about 200° C. to about 230° C. Any suitable pulping time can be used. In one embodiment, the pulping step is conducted for a time within a range of from about 20 minutes to about 150 minutes.

Any suitable equipment can be used for the solvent pulping step. Various types of reaction vessels called digesters are well known in the art for use in pulping processes. For example, the equipment may be a batch or continuous digester or a displacement digester.

As shown in FIG. 1, the pulp may be washed following the pulping step. Any suitable pulp washing method can be used, such as contacting the pulp with a wash water to remove impurities and remaining solution from the pulp. In one embodiment, the pulp is thoroughly washed first with a solvent-water mixture and then with water in a countercurrent washing system. The washing step produces unbleached pulp and spent liquor.

The spent liquor leaving the washing step will contain mostly degraded lignin and dissolved sugars. In one embodiment of the process, most of the high molecular weight lignin is precipitated in a first treatment stage following the washing. The lignin can be precipitated by any suitable method, for example by acidification (sulfuric acid or $CO_2$) of the spent liquor. In one embodiment, sugar components and low molecular lignin still remaining in the liquor are then removed in a second treatment stage. Any suitable separation technology can be used for this stage. Some examples of possible separation technologies are ion-exchange or membrane filtration. The purified liquor may be reused in the next pulping process with addition of some make-up solvent. The lignin and sugar components in the spent pulping liquor may be converted into more valuable chemical products such as diols and diacids, which may also be used as make-up for the pulping solvent.

In some embodiments, the overall process will produce bio-based chemicals in three separated extraction streams as well as bleachable grade pulp and paper.

In some embodiments, the process further includes an adsorption step in which hemicellulose is adsorbed on the pulp. FIG. 1 shows an adsorption step following the pulp washing step. In the illustrated embodiment, part of the aqueous solution containing the extracted hemicellulose from the pre-extraction step bypasses the pulping step and pulp washing and is combined with the pulp in the adsorption step. The term "adsorbed", as used herein, includes any mechanism by which the hemicellulose is combined with the pulp, such as adsorption, absorption, coagulation, coprecipitation, or the like. The hemicellulose can be adsorbed on the pulp in any suitable manner. For example, the washed pulp can be contacted with the aqueous solution from the pre-extraction step to adsorb a portion of the dissolved wood sugars including hemicellulose onto the pulp fibers. Alternatively, the hemicellulose adsorbed on the pulp in the adsorption step could be derived from another source.

In some embodiments, adsorption times are equal to or greater than 5 minutes, e.g. from about 5 to about 100 minutes, and pulp consistency is from about 1% to about 15%. In some embodiments, adsorption pH is 7 or greater and adsorption temperature is within a range of from about room temperature to about 150° C. The adsorption of the hemicellulose and other sugars on the pulp increases the pulp yield. In one embodiment, the pulp yield at the end of the adsorption step is higher than the pulp yield of a process that includes the same pulping step without the pre-extraction and adsorption steps. For example, the pulp yield may be increased by at least about 1%, or by at least about 3%, on a dry material weight basis. For example, the total pulp yield may be at least about 47%. In another embodiment of the process that does not include the adsorption step, the total pulp yield may be at least about 45%. The pulp produced by the process may be stronger and better in overall quality than a kraft pulp.

As shown in FIG. 1, the pulp at the end of the adsorption step may be referred to as a brown stock pulp. Additionally, the process may result in a sugar rich extract following the adsorption step, which is the aqueous solution including any hemicellulose and other sugars that are not adsorbed on the pulp during the adsorption step. This sugar rich extract is a feed stream which is available for the production of value-added materials.

Optionally, the process can also include subjecting the brown stock pulp to delignification and/or bleaching to lighten or brighten the color of the pulp. For example, a lighter colored pulp is desirable for applications such as paper making. Any suitable process(es) can be used, such as delignification and bleaching of the pulp with elemental chlorine, oxygen or ozone. However, in one embodiment the pulp is delignified and/or brightened without the use of chlorine. For example, the bleaching step may include oxygen delignification, ozone delignification and/or hydrogen peroxide brightening. In a particular embodiment, the pulp is bleached using a totally chlorine free (TCF) sequence, which includes first an oxygen delignification, followed by an ozone delignification, and a final brightening by a hydrogen peroxide treatment.

The pulp produced by the process can be used for the production of paper and paperboard and a wide variety of other applications.

In accordance with the provisions of the patent statutes, the principle and mode of operation of this invention have been described in its preferred embodiments. However, it must be understood that this invention may be practiced otherwise than as specifically described without departing from its spirit or scope.

What is claimed is:

1. A process of treating a lignocellulosic material comprising:

in a pre-extraction step, extracting hemicellulose from the lignocellulosic material by contacting the lignocellulosic material with an aqueous solution of a basic material in water, the aqueous solution having a pH sufficiently basic at the beginning of the pre-extraction step so that the aqueous solution at the end of the pre-extraction step has a pH within a range of from about 4.5 to about 9.5 measured at a temperature of 20° C.; then in a solvent pulping step, separating the lignocellulosic material into pulp by contacting the lignocellulosic material with a cooking liquor comprising an organic solvent having a standard boiling point of at least about 150° C.; then in an adsorption step, adsorbing the extracted hemicellulose on the pulp while controlling the adsorption step pH from about 9 to about 14, recovering a sugar rich extract not adsorbed in the adsorption step and producing value-added materials from said sugar rich extract, wherein the pulp yield at the end of the adsorption step is higher than the pulp yield of the same process without the pre-extraction and adsorption steps.

2. The process of claim 1 wherein the cooking liquor further comprises water.

3. The process of claim 2 wherein the organic solvent is completely miscible in the water.

4. The process of claim 1 wherein the organic solvent is an oxygen-containing organic solvent.

5. The process of claim 1 wherein the organic solvent is selected from the group consisting of 1,3-propanediol, 1,4-butanediol, tetrahydrofurfuryl alcohol, succinic acid, levulinic acid, lactones derived from hydroxy propionic or hydroxyl butyric acid, and mixtures thereof.

6. The process of claim 1 wherein the cooking liquor excludes any sodium and sulfur not present in the lignocellulosic material.

7. The process of claim wherein the cooking liquor has a ratio of organic solvent to water within a range of from about 1:1 to about 5:1.

8. The process of claim 1 wherein the cooking liquor has a temperature within a range of from about 180° C. to about 250° C.

9. The process of claim 1 further comprising converting at least part of the extracted hemicellulose into the organic solvent.

10. The process of claim 1 further comprising recovering and recycling at least part of the organic solvent from the solvent pulping step.

11. The process of claim 1 wherein the total pulp yield is at least about 45%.

12. The process of claim 1 wherein the pre-extraction step extracts at least about 4% of the lignocellulosic material on a dry weight basis.

13. The process of claim 1 further comprising a bleaching step, after the solvent pulping step, in which the pulp is delignified and/or brightened without the use of chlorine.

14. The process of claim 13 wherein the pulp is bleached using a totally chlorine free sequence, which includes first an oxygen delignification, followed by an ozone delignification, and a final brightening by a hydrogen peroxide treatment.

15. The process of claim 1 further comprising a separation step in which sugar components and low molecular weight lignin are separated from spent liquor after the solvent pulping step.

16. The process of claim 1 wherein the pre-extraction step is conducted by contacting the lignocellulosic material with an aqueous solution of an alkali metal carbonate in water.

17. The process of claim 1 wherein the aqueous solution further includes an additive that improves extraction.

18. The process of claim 1 wherein the organic solvent has a standard boiling point of at least about 160° C.

19. The process of claim 1 wherein the organic solvent has a standard boiling point of at least about 170° C.

20. The process of claim 1 wherein the aqueous solution at the end of the pre-extraction step has a pH within a range of from about 6 to about 8 measured at a temperature of 20° C.

21. The process of claim 1 wherein the pulp yield is increased by at least about 3% on a dry material weight basis.

22. The process of claim 1 wherein one of anthraquinone, anthraquinone derivatives and mixtures thereof is contacted with the lignocellulosic material in the pre-extraction step.

* * * * *